US008342147B2

(12) United States Patent
Nouvel et al.

(10) Patent No.: US 8,342,147 B2
(45) Date of Patent: Jan. 1, 2013

(54) OPTIMIZED GENERATION OF A RADIOFREQUENCY IGNITION SPARK

(75) Inventors: Clement Nouvel, Verneuil sur Seine (FR); Andre Agneray, Boulogne (FR); Xavier Jaffrezic, Velizy Villacoublay (FR)

(73) Assignee: Renault S.A.S., Boulogne Billancourt (FR)

( * ) Notice: Subject to any disclaimer, the term of this patent is extended or adjusted under 35 U.S.C. 154(b) by 526 days.

(21) Appl. No.: 12/529,348

(22) PCT Filed: Feb. 13, 2008

(86) PCT No.: PCT/FR2008/050227

§ 371 (c)(1),
(2), (4) Date: May 25, 2010

(87) PCT Pub. No.: WO2008/110726

PCT Pub. Date: Sep. 18, 2008

(65) Prior Publication Data

US 2010/0251995 A1 Oct. 7, 2010

(30) Foreign Application Priority Data

Mar. 1, 2007 (FR) ..... 07 01498

(51) Int. Cl.
*F02B 19/00* (2006.01)
*F02P 23/00* (2006.01)
*F02P 3/02* (2006.01)

(52) U.S. Cl. ..... 123/143 B; 123/620

(58) Field of Classification Search ..... 123/143 B, 123/143 R, 596, 620, 633, 600, 604, 605; 315/111.21, 111.51
See application file for complete search history.

(56) References Cited

U.S. PATENT DOCUMENTS

| | | | | |
|---|---|---|---|---|
| 4,398,526 | A * | 8/1983 | Hamai et al. | 123/606 |
| 7,013,881 | B2 * | 3/2006 | Metzelard | 123/594 |
| 7,467,612 | B2 * | 12/2008 | Suckewer et al. | 123/143 R |
| 2004/0094124 | A1 | 5/2004 | Viele et al. | |
| 2004/0129241 | A1 * | 7/2004 | Freen | 123/143 B |
| 2004/0237950 | A1 | 12/2004 | Metzelard | |
| 2009/0165764 | A1 * | 7/2009 | Agneray et al. | 123/606 |

FOREIGN PATENT DOCUMENTS

| | | |
|---|---|---|
| DE | 10 2005 036 968 | 2/2007 |
| FR | 2 859 869 | 3/2005 |
| WO | 93 10348 | 5/1993 |
| WO | 03 010434 | 2/2003 |

* cited by examiner

*Primary Examiner* — Stephen K Cronin
*Assistant Examiner* — Sizo Vilakazi
(74) *Attorney, Agent, or Firm* — Oblon, Spivak, McClelland, Maier & Neustadt, L.L.P.

(57) ABSTRACT

A method for controlling a radio-frequency plasma generator including a supply circuit with a switch controlled by at least one control pulse train, for applying an intermediate voltage at a control frequency on an output to which is connected a resonator for generating a spark between two electrodes when a high voltage level is applied to the output. The method receives first and second measurement signals respectively representative of the operation of a combustion engine and of the type of spark generated; and real-time adjusts, based on the received measurement signals, at least one parameter selected from at least the intermediate voltage level, the control frequency, and the duration of the control train, to promote branching of the spark generated.

9 Claims, 2 Drawing Sheets

OPTIMIZED GENERATION OF A RADIOFREQUENCY IGNITION SPARK

The present invention relates to the control of the power supply to a plasma generation resonator, in particular in a motor vehicle plasma ignition application based on the radiofrequency stressing of the resonator of a multi-spark plug.

In the field of modern motor vehicle ignition systems, the multi-spark plug BME offers a significant innovation and a geometry that is different from conventional spark plugs. Such a BME is described in detail in the following patent applications in the name of the applicant FR 03-10766, FR 03-10767, FR 03-10768, FR 04-12153 and FR 05-00777.

A BME comprises a resonator whose resonance frequency $F_c$ is situated in the high frequencies, typically between 4 and 6 MHz, to ensure that the plug is supplied with a resonance-amplified voltage. The application by the resonator to the electrodes of the plug of an alternating current voltage in the radiofrequency range makes it possible to develop multi-filament discharges between the electrodes of the plug, over distances of the order of a centimeter, at high pressure and for peak voltages less than 20 kV.

The term "branched sparks" then applies, based on the fact that they involve the simultaneous generation of at least several ionization lines or paths in a given volume, their branchings also being omnidirectional.

The controlling of the power supply of such a BME involves the use of a high-voltage generator whose operating frequency is very close to the resonance frequency of the radiofrequency resonator. The smaller the difference between the resonance frequency of the resonator and the operating frequency of the generator, the higher the overvoltage coefficient of the resonator (ratio between the amplitude of its output voltage and its input voltage).

Such a voltage generator, detailed in the patent application FR 03-10767, primarily consists in using a resonator control frequency that is as close as possible to the resonance frequency of the resonator, in order to benefit from an overvoltage coefficient that is as high as possible.

It is observed, however, that, if the total amplitude of the voltage applied at the output of the resonator to the electrodes of the plug is too high, there is a risk of the spark being concentrated in a single filament. This phenomenon, that will be described by the term "bridging" hereinafter in the description, localizes the energy in a small filament area, rendering the discharge much less effective in initiating the ignition of the air-fuel mixture between the electrodes, compared to a branched spark.

The aim of the present invention is to remedy this drawback, by making it possible to maximize in real time the volume of the spark generated while reducing the occurrence of the bridging effects, that is, the appearance of filament discharges.

With this objective in mind, the subject of the invention is a method of controlling a radiofrequency plasma generator, comprising:

- a supply circuit with a switch controlled by a control signal in the form of at least one control pulse train, applying an intermediate voltage to an output of the supply circuit at the frequency defined by the control signal,
- a resonator, connected to the output of the supply circuit and able to generate a spark between two electrodes when a high voltage level is applied to the output of the supply circuit, said method being characterized in that it comprises:

- the reception of first measurement signals representative of the operation of a combustion engine,
- the reception of second electrical measurement signals representative of the type of spark generated, and
- the real-time regulation, according to the first and second measurement signals received, of at least one parameter taken from at least the intermediate voltage level, the control frequency, the duration of the control pulse train, so as to favor a branching of the generated spark.

According to one embodiment, the method comprises the combined regulation of the level of the intermediate voltage and the duration of the control pulse train.

Advantageously, the control signal being generated in the form of a plurality of control pulse trains, the regulation relates to the number of said trains and the inter-train time.

Advantageously, the method comprises the storage of relationships between measurement signals and the value of the parameters to be regulated, the regulation consisting in determining and applying the value of at least the parameter to be regulated according to the measurement signals received and the stored relationships.

Preferably, the first measurement signals are chosen from the group comprising the engine oil temperature, the engine coolant temperature, the engine torque, the engine speed, the ignition angle, the intake air temperature, the manifold pressure, atmospheric pressure, pressure in the combustion chamber or the maximum pressure angle.

Preferably, the second measurement signals comprise at least one measurement of the voltage at the terminals of a storage capacitor supplying the intermediate voltage at the input of the resonator and/or at least one measurement of the current in the resonator.

According to one embodiment, a first measurement of the voltage at the terminals of the storage capacitor is made before, or at the start of, the control pulse train, and a second measurement of said voltage is made after, or at the end of, the control pulse train.

According to a variant, a plurality of measurements are performed during the control pulse train.

Preferably, the method comprises the regulation of the control frequency to a setpoint value that is roughly equal to the resonance frequency of the resonator.

The invention also relates to a device for generating radiofrequency plasma comprising:

- a supply circuit with a switch controlled by a control signal in the form of at least one control pulse train, the switch applying an intermediate voltage to an output of the supply circuit at the frequency defined by the control signal,
- a resonator, connected to the output of the supply circuit and able to generate a spark between two electrodes when a high voltage level is applied to the output of the supply circuit, said device being characterized in that it comprises a control module suitable for implementing the method as claimed in any one of the preceding claims.

Other features and benefits of the present invention will become more clearly apparent on reading the following description given by way of illustrative and nonlimiting example, and with reference to the appended figures in which.

Figure 1:
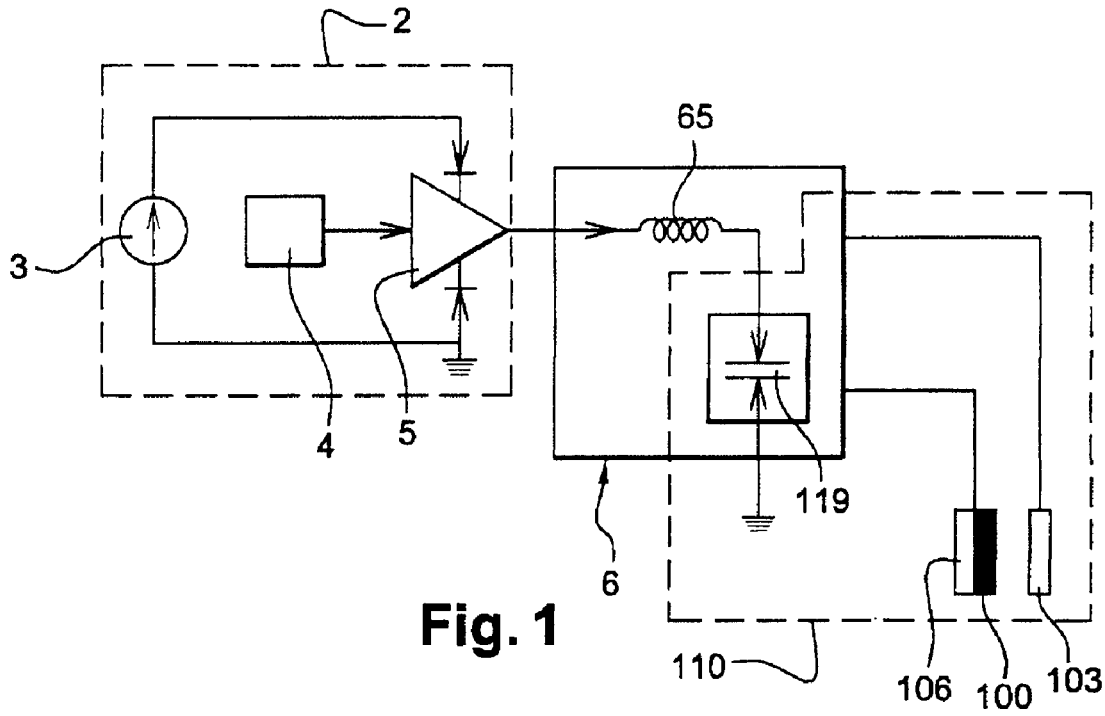
FIG. 1 illustrates an embodiment of a plasma generation device.

Referring to FIG. 1, a plasma-generating device mainly comprises three functional subassemblies:

- a power supply 2, designed to resonate an L-C structure at a frequency greater than 1 MHz with a voltage at the terminals of the capacitor greater than 5 kV, preferably greater than 6 kV;
- a resonator 6, connected to the output of the supply circuit, exhibiting an overvoltage factor greater than 40 and a resonance frequency greater than 1 MHz;
- a plug head 110, comprising two electrodes 103 and 106 separated by an insulator 100, for generating a branched plasma on the application of the radiofrequency excitation to the terminals of its electrodes.

The power supply circuit 2 advantageously comprises:

- a low voltage power supply 3 (generating a DC voltage less than 1000 V);
- a radiofrequency amplifier 5, amplifying the DC voltage and generating an AC voltage at the frequency controlled by the switching control 4.

The AC voltage generated by the amplifier 5 is applied to the LC resonator 6. The LC resonator 6 applies the AC voltage between the electrodes 103 and 106 of the plug head.

The voltage supplied by the power supply 3 is less than 1000 V and the supply preferably offers a limited power. It is thus possible to provide for the energy applied between the electrodes to be limited to 300 mJ for each ignition, for safety reasons. The current intensity in the voltage generator 2, and its electrical consumption, are thus also restricted. To generate DC voltages greater than 12 V in a motor vehicle application, the power supply 3 can include a 12 volt to Y volt converter, Y being the voltage supplied by the power supply to the amplifier. It is thus possible to generate the desired DC voltage level from a battery voltage. The stability of the DC voltage generated is not a priori a determining criterion, so it is possible to allow for the use of a switched-mode power supply to supply the amplifier, for its qualities of robustness and simplicity.

The supply circuit 2 is used to concentrate the highest voltages on the resonator 6. The amplifier 5 thus processes voltages that are much lower than the voltages applied between the electrodes of the plug.

The amplifier 5 is used to accumulate energy in the resonator 6 on each alternation of its voltage. Preferably, a class E amplifier 5, as detailed in the U.S. Pat. No. 5,187,580, is used. Such an amplifier makes it possible to maximize the overvoltage factor. Those skilled in the art will obviously associate a suitable switching device with the chosen amplifier, to support the voltage step-up requirements and offer an adequate switching speed.

Figure 2:
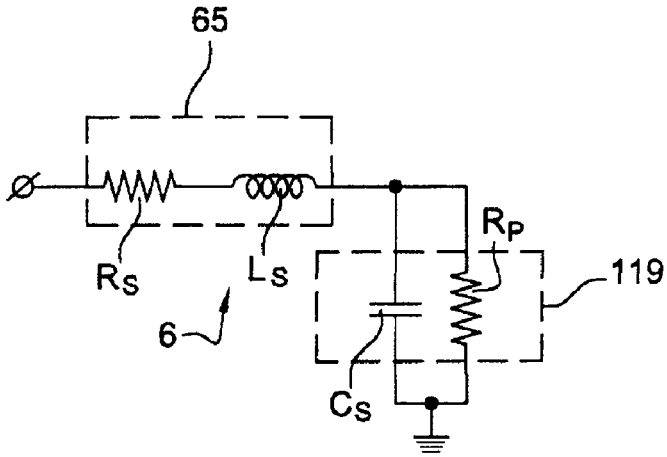
FIG. 2 illustrates an electrical model used for the resonator.

FIG. 2 illustrates an electrical model of the resonator 6. Thus, the series inductance 65 has in series an inductance Ls and a resistance Rs taking into account the skin effect in the radiofrequency domain. The capacitor 119 offers in parallel a capacitance Cs and a resistance Rp. The ignition electrodes 106 and 103 are connected to the terminals of the capacitance Cs.

The resistance Rp is added to model the discharge and corresponds where appropriate to the dissipation in the ceramic of the plug. When the resonator is supplied by a voltage at its resonance frequency $f_0$ $(1/(2\pi\sqrt{L*C})$, the amplitude at the terminals of the capacitance Cs is amplified by the overvoltage coefficient Q defined by the following formula:

$$Q = \frac{1}{\frac{\sqrt{\frac{Ls}{Cs}}}{Rp} + \frac{Rs}{\sqrt{\frac{Ls}{Cs}}}}$$

The plasma generation device that has been described can include a plasma-generating resonator suitable for producing a controlled ignition of a combustion engine, an ignition in a particle filter, or a decontamination ignition in an air conditioning system.

Figure 3:
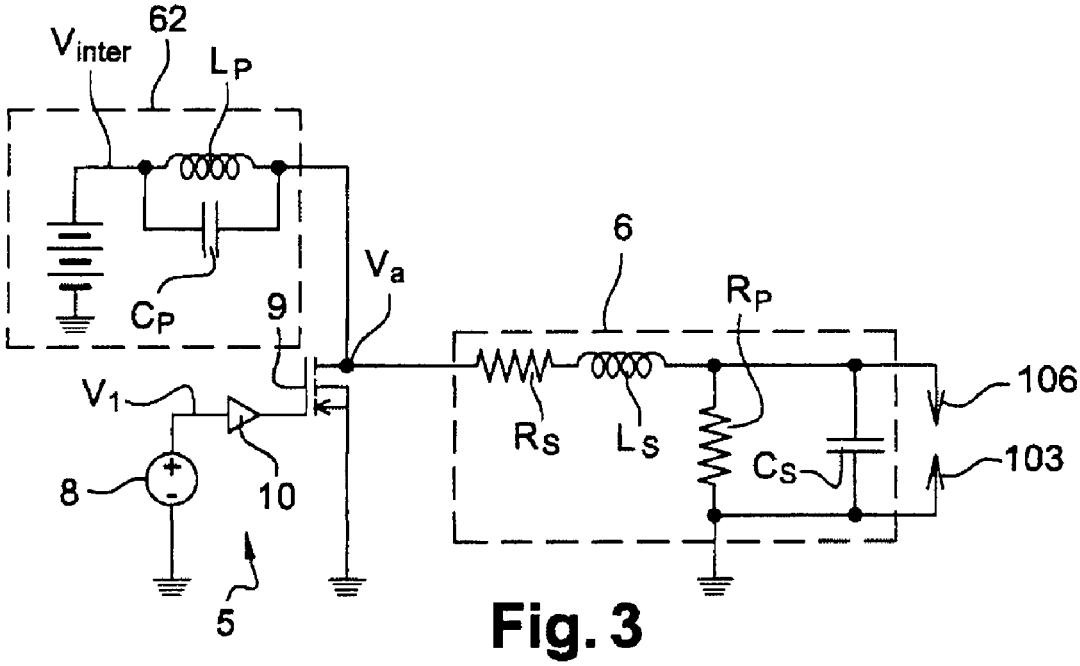
FIG. 3 illustrates a circuit diagram of the radiofrequency ignition.

FIG. 3 illustrates a circuit diagram of the radiofrequency ignition according to one embodiment of an amplifier 5, having a power MOSFET transistor as the switch controlling the switching at the terminals of the resonator 6.

Thus, a control signal generator 8 applies a control signal V1 at a control frequency to the gate of a power MOSFET 9, via an amplification device 10 that is diagrammatically represented. In order to monitor the production of sparks between the electrodes of the plug when its resonator is excited via the control signal V1, the latter is not permanent but is present in the form of control pulse trains at the control frequency.

As described in the patent application EP-A-1 515 594, a parallel resonant circuit 62 is connected between an intermediate voltage source Vinter and the drain of the transistor 9. This circuit 62 comprises an inductance Lp in parallel with a capacitance Cp.

The parallel resonator transforms the intermediate voltage Vinter into an amplified voltage Va, which is supplied to the drain of the transistor 9 linked to the input of the resonator 6.

The transistor 9 therefore acts as a switch and transmits (respectively blocks) the voltage Va at the input of the resonator 6 when the control signal V1 is in high (respectively low) logic state.

Figure 4:
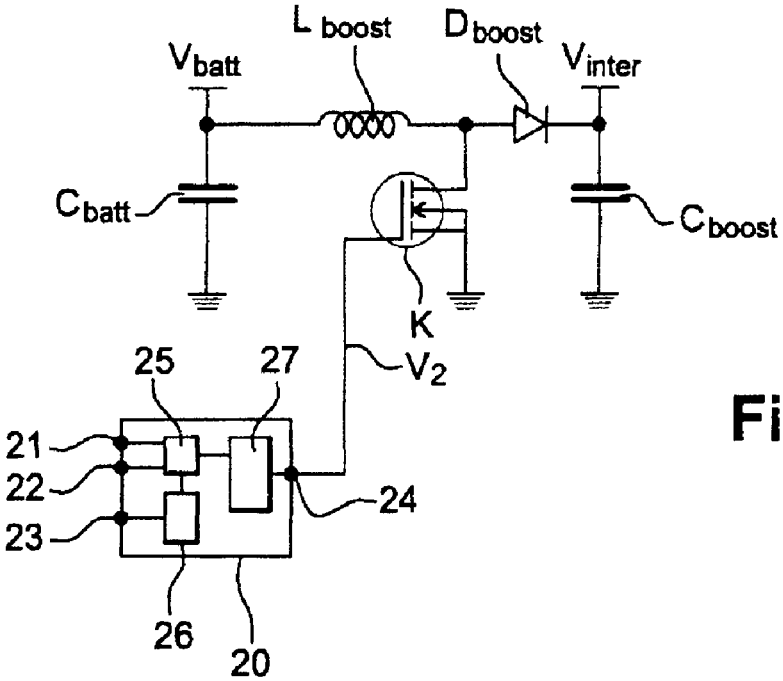
FIG. 4 illustrates a device for generating the intermediate voltage used in the radiofrequency ignition incorporating a monitoring module according to the invention.

The intermediate voltage Vinter, supplied at the input of the parallel resonant circuit 62, is typically generated via a voltage step-up device, diagrammatically represented in FIG. 4.

The voltage step-up circuit is, for example, supplied from a battery voltage Vbat and consists of an inductance Lboost, a MOSFET K, which serves as switch driven by a monitoring module 20, a diode Dboost, and a capacitor Cboost. The monitoring module delivers a control signal V2 in the form of a high-frequency pulse train, so that the switch K is made to conduct periodically. When K is closed, the inductance Lboost is charged with the voltage Vbat at its terminals. When K is open, the diode Dboost conducts and the energy stored in the inductance gives rise to a current which will be directed to the output and the capacitor Cboost to charge it.

The storage capacitance Cboost is charged in this way until the desired value of Vinter is reached. For this, a regulation loop that is not represented measures, at any instant, the value of the voltage at the terminals of the capacitance Cboost and orders the monitoring module to stop the voltage step-up at the output when the desired value is reached.

The voltage step-up process is disabled in all cases at the start of and during the ignition control train.

To generate the discharge from the plug, a certain quantity of energy is taken from the capacitance Cboost to be supplied, after amplification by the resonant circuit 62, to the input of the resonator 6, so as to enable the application of a high voltage level between the terminals of the electrodes at a frequency defined by the control signal applied to the switch 9. Upon ignition, the voltage Vinter at the terminals of the capacitance Cboost drops. It is therefore necessary to recharge it for the next discharge. Thus, between two discharges, the voltage step-up process as explained previously is repeated.

The invention provides for acting on a certain number of operating parameters of the system, or on at least one of them, in order to minimize the bridging phenomenon when the plug is discharged, in particular: the supply voltage of the resonator designed to apply the high voltage to the terminals of the electrodes, the excitation frequency of the resonator, the duration of the control train, the possibility of producing a number of trains and their number, and the time between the trains. These parameters may advantageously be adjustable while the system is operating, and their adjustment in real time, as will be explained in more detail hereinbelow, should make it possible to obtain an optimum branching of the discharge by limiting the occurrence of the bridging phenomena.

Inasmuch as the voltage level applied between the terminals of the electrodes firstly affects the development of the discharge (and therefore the possibility of the appearance of the bridging), it is therefore possible initially to envisage limiting the latter during the discharge in order to avoid the bridging phenomena.

To do this, it is possible to envisage using an intermediate voltage level at the terminals of the capacitance Cboost before reduced ignition, compared to the voltage level Vinter used upon the generation of plasma with bridging, by defining a voltage setpoint to be implemented at the terminals of the storage capacitance Cboost that can be adjusted in real time. The expression "real time" should be understood to mean the updating of this setpoint between one ignition and the next on the same cylinder. In practice, the voltage at the terminals of Cboost before ignition ultimately determines the amplitude of the voltage at the terminals of the electrodes of the resonator upon discharge.

The voltage setpoint applied must be such that it makes it possible to place the system in optimum conditions from the combustion point of view, namely a branching of the spark of maximum value for a voltage amplitude applied to the terminals of the electrodes just below the high voltage limit from which the bridging occurs.

The real-time regulation of the intermediate voltage value to be produced at the terminals of Cboost takes into account combustion engine operating parameter measurement signals.

Advantageously, the real-time regulation of the optimum intermediate voltage value to be produced at the terminals of the capacitance Cboost can be refined by also taking into account electrical measurement signals of the resonator 6 power supply, representative of the type of spark produced.

In practice, the analysis of certain signals makes it possible to know with more or less accuracy the type of spark produced and the type of combustion that results therefrom. The processing of these signals then makes it possible to produce a servo-control on the value of the voltage to be produced at the terminals of the capacitance Cboost before ignition, so as to optimize the type of sparks developed in the combustion chamber, in particular their volume.

The regulation process then determines the value of the setpoint of the voltage to be produced before ignition on the terminals of Cboost, according to stored relationships between these measurement signals and the voltage value to be applied to the terminals of Cboost.

By thus adapting in real time the value of the voltage to be applied to the terminals of the capacitance Cboost before ignition, according to engine operating parameters, on the one hand, and electrical measurements of the resonator power supply representative of the type of spark generated on the other hand, it will be possible to keep this voltage very accurately at a value that is both sufficient to generate a spark between the electrodes and thus initiate the ignition, when it is applied via the resonator to the terminals of the electrodes, while being less than the high voltage limit from which the bridging occurs.

Such a real-time servo-control of the intermediate voltage at the terminals of Cboost before ignition is produced via the monitoring module 20.

The latter thus comprises an interface 21 for receiving combustion engine operating parameter measurement signals. Among the engine operating parameters that are measured, it is possible to envisage the engine oil temperature, the engine coolant temperature, the engine torque, the engine speed, the ignition angle, the intake air temperature, the manifold pressure, the atmospheric pressure, the pressure in the combustion chamber, the maximum pressure angle or any quantity characteristic of the operation of the engine. These types of measurement can be performed in a manner that is known per se to those skilled in the art.

Advantageously, the monitoring module 20 also comprises an interface 22 for receiving electrical measurement signals, representative of the type of spark generated.

The monitoring module 20 comprises a memory module 26 which stores relationships between the measurement signals and the voltage value to be produced at the terminals of the capacitance Cboost before ignition. These relationships can be established according to preliminary tests. The memory module 26 can store the relationships in the form of a function associating predetermined measurement signals with a single voltage setpoint to be produced. It is possible, for example, to extrapolate a linear function or a polynomial function according to results of preliminary tests on a resonator by varying the various parameters taken into account. The memory module can also store the relationships in the form of a multidimensional array which takes measurement signals for its input.

The monitoring module 20 comprises a module 25 determining the voltage setpoint to be produced according to the measurement signals received and the relationships stored in the memory 26. The setpoint is supplied by the module 25 to a module 27, applying a control signal V2 to an output interface 24 suitable for controlling the voltage step-up process as explained hereinabove until the voltage value at the terminals of the capacitance Cboost reaches the setpoint value. The module 27 is, for example, a clock generator selected in an appropriate manner by a person skilled in the art.

A programming interface 23 can be provided, making it possible to receive and execute commands to modify relationships or parameters stored in the memory module 26. The programming interface 23 can notably be a wireless communication interface. Thus, it is possible to envisage updating the relationships stored in the module 26 in order to optimize the operation of the ignition system after its delivery.

The reception interface 22 preferably receives one or more measurements of the value of the intermediate voltage at the terminals of the storage capacitance Cboost and/or one or more measurements of the current entering into the resonator 6, and do so during the duration of the control pulse train or trains V1 controlling the generation of the spark.

The effect, as will be seen more specifically hereinbelow, the measurement of the trend of the voltage at the terminals of Cboost during an ignition command conveys many items of information concerning the branching of the spark.

As for the current entering into the resonator, it is an image of the high voltage at the terminals of the electrodes of the resonator. This signal, modulated at the resonance frequency (typically 5 MHz), has an envelope that is characteristic of the branched discharge and bridging phenomena. The analysis of the envelope of the current signal during the duration of an ignition command entails the use of a peak detector-type device, which is known per se, which supplies as output only the peak values of the modulated sinusoid of the current signal.

By studying these measurement signals, it is possible to diagnose the type of discharge or the spark produced and to modify accordingly, depending on predetermined laws stored in the monitoring module, the selected parameter or parameters, in this case the value of the intermediate voltage to be produced at the terminals of Cboost before ignition, according to the exemplary embodiment hereinabove.

The handling of the regulation based on the electrical measurements described hereinabove can be implemented in a number of ways.

According to a first embodiment, it is possible to envisage taking into account a single measurement characteristic of the type of spark generated, taken at the most representative instant of the development of the spark, or after or at the end of the spark generation control train.

If the chosen measurement is the measurement of the current in the resonator, it is then possible to determine a threshold value M1, such that:

- if the measurement taken at the end of the control train is less than this threshold value, it can be deduced therefrom that a bridging has occurred;
- if the measurement taken is greater than this threshold value, it can be deduced therefrom that no bridging has occurred.

In the case where the measurement of the voltage at the terminals of the storage capacitance Cboost is used, it is then necessary to consider the difference between the voltage at the terminals of this capacitance before (or at the start of) and after (or at the end of) the spark generation control train. In practice, the observation in particular of the voltage at the terminals of the storage capacitance Cboost before ignition (it is then the voltage setpoint regulated at the terminals of that capacitance) and after ignition (measurement taken at the end of the control train), makes it possible to deduce the energy consumed by the resonator during ignition. It is then possible to deduce therefrom the type of discharge produced, between no spark at all, branching and bridging, depending on the quantity of energy that will have been consumed by the resonator during the discharge.

In practice, it can be shown that, when a bridging takes place, the quantity of energy absorbed is minimized. It is then possible to determine, in the same way as previously, a threshold value M2 for which:

- if the measurement taken at the end of the control train implies a consumed energy less than this threshold value, it can be deduced therefrom that a bridging has occurred (which in practice reduces the energy value transmitted to the resonator);
- if the measurement taken implies a consumed energy greater than this threshold value, it can be deduced therefrom that no bridging has occurred.

It will be noticed however that a regulation based, as has just been explained, on a single measurement (of the current in the resonator or of the voltage on the storage capacitance) for each control train, preferably taken at the end of the control train, is not robust enough. In practice, the measurement taken is not only representative of the type of spark produced, but also of the frequency tuning between the supply circuit and the resonator, of the soiling of the plug and of other phenomena independent of the development of the spark.

Also, according to another embodiment, to provide a robust regulation, multiple electrical measurements are preferably taken during and/or before and/or after the control train. The analysis of the trend of these multiple measurements makes it possible to more easily extract relevant parameters for the qualification of the development of the spark and thus provide a regulation, in particular of the value of the intermediate voltage to be produced at the terminals of Cboost before ignition, that is more effective.

Notably, the measurement of the trend of the voltage at the terminals of Cboost during and/or before and/or after the duration of the control train conveys many items of information concerning the branching of the spark. During the development of the discharge, the energy consumption of the resonator is in effect reflected in a voltage drop at the terminals of the capacitance Cboost, that can be tracked. It is observed that an optimum branching of the generated spark consumes a lot of energy whereas the bridging phase strongly limits the consumption. The analysis of the slopes of the voltage drop at the terminals of Cboost thus makes it possible to detect the bridging and its instant of appearance.

It has also been seen that the analysis of the occurrence of the bridging effects can be based on the analysis of the current envelope at the input of the resonator. By taking multiple electrical measurements during and/or before and/or after the duration of the control train, it is then possible to track the trend of this current envelope. A bridging is always reflected in an abrupt drop on the current envelope, whereas, in the case of a branched discharge, the current envelope shows a slight decrease or a less rapid trend of the envelope. It is thus possible to detect the bridging phenomena by using mathematical tools of the "derivative" type applied to the multiple current measurements at the input of the resonator during and/or before and/or after the duration of the control train.

The regulation discussed hitherto in order to favor an optimum branching of the spark by minimizing the bridging phenomenon preferably acts on the value of the intermediate voltage to be produced at the terminals of the storage capacitance Cboost for each ignition. The regulation process thus makes it possible to define a voltage setpoint to be reached at the start of each ignition, according, on the one hand, to the measurement signals representative of the operation of the engine and, on the other hand, of the electrical measurement signals representative of the type of spark generated.

However, other system control parameters can also be taken into account in the real-time regulation process and thus be adjusted while the system is operating, in the same way as explained previously with reference to the regulation of the value of the intermediate voltage at the terminals of Cboost for each ignition.

The other operating parameters of the system involved in the development of the spark and likely to be modified in operation to adjust the system in real time are the control frequency of the resonator, the duration of the spark generating control pulse train, or even according to a variant consisting in producing multiple ignitions, the number of such control trains and the spacing between trains.

According to a preferred embodiment, the regulation according to the invention jointly concerns the value of the intermediate voltage at the terminals of Cboost for each ignition and the duration of the control pulse train V1, controlling the generation of the spark.

To do this, the monitoring module 20, or a similar module, is also used to generate the ignition control pulse train V1, the duration of which is then adjusted according to the measurement signals received and the stored relationships.

In practice, since the bridging phenomenon occurs during a control train and, generally, begins by occurring at the end of the control train, it is possible to avoid it by shortening the duration of the control pulse train so as to stop the latter just before the bridging (or just after, depending on the desired effect on the combustion).

However, for this, it is necessary for the bridging not to occur at any start of control train and, moreover, it is essential to be able to predict the instant of appearance of the bridging in order to adjust accordingly the optimum duration of the control train.

For these reasons, this technique for limiting the possibilities of bridging by reducing the duration of the ignition control train can be envisaged in conjunction with the technique of regulating the supply voltage of the resonator. In practice, the regulation of the resonator supply voltage, which consists in defining a reduced intermediate voltage level at the terminals of the capacitance Cboost before ignition, advantageously makes it possible to push back the bridging phenomenon as far as possible from the start of the control train.

According to a variant, it is proposed to control the resonator during ignition via a control signal in the form of a plurality of control pulse trains, each train having a very short duration, for example of the order of 5 to 10 μs, so that no bridging has the time to occur. In this variant which consists in producing multiple ignitions, it is necessary to reproduce the control trains a certain number of times, of the order of 2 to 50 times for example, to ensure an adequate energy transfer to the mixture for which combustion is to be initiated. Furthermore, to provide a good dissociation between the trains and so avoid the bridging, the spacing between the different pulse trains of the control signal can be regulated in the direction of an increase. The ignition time is then however increased, which can be unfavorable to the mixture initiation conditions.

Also, upon ignition, the frequency of the resonator control signal is preferably chosen to be of the order of magnitude of the resonance frequency of the resonator 6. In practice, the match between the resonance frequency of the resonator and the frequency at which the latter is controlled (i.e. the frequency of the control signal), determines the ratio between the voltage amplitude at the input and at the output of the resonator. Thus, by preferably using a control frequency that is substantially equal to the resonance frequency of the resonator, the efficiency of the resonator is favored, inasmuch as its overvoltage coefficient Q is then as high as possible.

However, in order to limit the voltage applied between the electrodes of the resonator and thus limit the probability of the appearance of the bridging phenomena, it is possible to envisage degrading the overvoltage coefficient by shifting the control frequency around the resonance frequency of the resonator. Thus, the value of the control frequency can also be the subject of the anti-bridging regulation as explained previously, by determining an optimum control frequency value offset relative to the resonance frequency, according to the measurements received (engine operation and electrical). This parameter can be regulated on its own, or even jointly with the intermediate voltage value, the duration of the control train, or even jointly with the latter two parameters.

The invention claimed is:

1. A method of controlling a radiofrequency plasma generator, including a supply circuit with a switch controlled by a control signal in a form of at least one control pulse train, applying an intermediate voltage to an output of the supply circuit at the frequency defined by the control signal, a resonator connected to the output of the supply circuit to generate a spark between two electrodes when a high voltage level is applied to the output of the supply circuit, the method comprising:

reception of first measurement signals representative of an operation of a combustion engine;

reception of second electrical measurement signals representative of a type of spark generated; and combined and real time regulation, according to the first and second measurement signals received, of a level of the intermediate voltage and of duration of the control pulse train.

2. The method as claimed in claim 1, wherein the control signal is generated in a form of a plurality of control pulse trains, and the regulation relates to a number of trains and inter-train time.

3. The method as claimed in claim 1, further comprising storage of relationships between measurement signals and value of parameters to be regulated, the regulation determining and applying the value of the parameters to be regulated according to the measurement signals received and the stored relationships.

4. The method as claimed in claim 1, wherein the first measurement signals are chosen from the group comprising engine oil temperature, engine coolant temperature, engine torque, engine speed, ignition angle, intake air temperature, manifold pressure, atmospheric pressure, pressure in the combustion chamber, or maximum pressure angle.

5. The method as claimed in claim 1, wherein the second measurement signals comprise at least one measurement of a voltage at terminals of a storage capacitor supplying the intermediate voltage at an input of the resonator and/or at least one measurement of current in the resonator.

6. The method as claimed in claim 5, wherein a first measurement of the voltage at the terminals of the storage capacitor is made before, or at start of the control pulse train, and a second measurement of the voltage is made after, or at end of, the control pulse train.

7. The method as claimed in claim 5, wherein a plurality of measurements are performed during the control pulse train.

8. The method as claimed in claim 1, further comprising regulation of control frequency to a setpoint value that is roughly equal to resonance frequency of the resonator.

9. A device for generating radiofrequency plasma comprising:

a supply circuit with a switch controlled by a control signal in a form of at least one control pulse train, the switch applying an intermediate voltage to an output of the supply circuit at the frequency defined by the control signal;

a resonator connected to the output of the supply circuit and to generate a spark between two electrodes when a high voltage level is applied to the output of the supply circuit; and a control module configured to implement the method as claimed in claim 1.

* * * * *